US005356149A

United States Patent [19]

Kane

[11] Patent Number: 5,356,149

[45] Date of Patent: Oct. 18, 1994

[54] INJECTION MOLDED WATER-SOLUBLE GOLF BALL

[76] Inventor: Patrick E. Kane, 4059 Bonita View Dr., Bonita, Calif. 91902

[21] Appl. No.: 996,964

[22] Filed: Dec. 23, 1992

[51] Int. Cl.[5] ..... A63B 37/02; A63B 37/12

[52] U.S. Cl. ..... 273/218; 264/328.1

[58] Field of Search ..... 273/218, 62, 220

[56] References Cited

U.S. PATENT DOCUMENTS 5,098,104 3/1992 Kane ..... 273/218 X

*Primary Examiner*—George J. Marlo

*Attorney, Agent, or Firm*—Gilliam, Duncan & Harms

[57] ABSTRACT

An injection molded water soluble golf ball of unitary construction formed entirely from a liquid mixture comprising a non-toxic water soluble filler material mixed with a water soluble thermo setting adhesive material which when combined, injected into the proper sized closed mold cavity under high pressure and heat cured forms a dimpled water soluble golf ball that has substantially the same appearance, weight, size and playing characteristics of a conventional regulation golf ball.

10 Claims, 1 Drawing Sheet

INJECTION MOLDED WATER-SOLUBLE GOLF BALL

BACKGROUND OF THE INVENTION

1. Field of the Invention

This invention relates to golf balls and more particularly to water-soluble golf balls.

2. Prior Art

Throughout the United States and the industrialized world golf is one of the most popular leisure sports enjoyed by a wide range of citizens. A common exercise of the world golfing population involves the practice and perfecting of golfing abilities by the hitting dozens of golf balls at public and private practice facilities known as driving ranges. A common and familiar sight to a golfer frequenting driving ranges is the thousands of golf balls which cover the driving range area prior to their retrieval.

Another popular pastime for golf patrons who take sea cruises aboard cruise lines is to practice their golfing skills by driving golf balls from the ships deck directly into the water surrounding the ship. In the not too distant past many a seagoing golfer was able to practice his golf ball driving skills aboard almost all such cruise line ships.

Because the thousands of golf balls ejected from cruise ships have a polluting effect on the marine environment and the aquatic life therein a statute was enacted by the International Maritime Organization (MARPOL) banning the dumping of refuse containing plastic into the world's oceans. The practice of driving golf balls has been virtually banned by most cruise ship lines because they contained plastic and other insulating material banned by the MARPOL.

Since golf balls are made of plastic and/or rubber and other insoluble materials, the balls driven from cruise ships into the sea, or from land based driving ranges into a water continue to exist in that environment for many years. These golf balls, when ingested by sea life and fresh water dwelling creatures, may cause death or illness due to choking, bowel obstruction or ingestion of toxic substances.

Widely used insoluble golf balls disclosed by the prior art and noted below are made to endure in the harsh golf club environment for years. Thus, driving ranges used by thousands of persons practicing swing and distance golf ball driving are limited to spaces of land which allow for the easy retrieval of the golf balls used thereon.

There is great advantage of waster soluble golf balls over widely used insoluble golf balls since the water soluble golf ball armlessly dissolves into the environment into which they were driven. Using water soluble golf balls, driving balls from ships at sea or on freshwater can be considered safe for animals and plants existing in the aquatic environment. Additional areas on land also become available for driving ranges along lakes, sea shores, swamps, and other areas since golf balls that dissolve no longer need to be retrieved.

U.S. Pat. No. 5,098,104 (Kane) teaches a two piece golf ball providing conventional golf ball performance characteristics and comprised of a water soluble core encased in a water soluble external skin. The water soluble skin is adhered to the water soluble core with a water soluble adhesive. The entire golf ball will dissolve in water after a period of time.

Kane is at the forefront of water soluble golf ball manufacturing and injection molding of water soluble golf balls and this invention is an improvement upon his unique invention set forth in the above referenced patent to Kane by eliminating some manufacturing steps thereby lessening costs and labor presently required to fabricate water soluble golf balls from multiple parts.

U.S. Pat. No. 4,014,541 (Desmarias) teaches a golf tee composed of water thermoplastic material which is water soluble. While addressing the need for water soluble products in the golfing environment Desmarias only discloses a platform to place golf balls upon which if lost or disposed of on a golf course or lawn will not damage lawn mower blades. Desmarias does not teach how to the manufacture a golf ball having similar playing characteristics as normally used golf balls which would be water soluble.

U.S. Pat. No. 2,374,692 (Miller) teaches an oxidized soy bean oil mixed with rubber materials to produce a material of uniform composition for the covering of golf balls. The intent of Miller, however, is to use the soy bean oil to produce a long lasting golf ball cover which is extremely tough and resilient and similar in performance to vulcanized rubber covers. In using such a long lasting material the Miller patent teaches against the use of natural and water soluble substances which will produce water soluble golf balls that will dissolve in water in a short period of time.

U.S. Pat. No. 4,697,807 (Boundy) teaches a simulated golf ball which breaks down into finely divided particles when struck by a golf club. Boundy thus, does not have the conventional playing characteristics of normal golf balls. The Boundy patent is directed to a golf ball that is intended to be a novelty or gag golf ball which breaks down into a fine powder upon being struck by a golf club. Thus the Boundy ball cannot be driven the long distances required in the normal play or practice of golf and would therefor be unusable in any normal golfing applications.

Great Britain Patent 9584 (Rofe) teaches the use of paper pulp as a water soluble component of ball manufacture, however the outer ball surface material as taught by Rofe propounds the use of leather which is neither water soluble over a short period of time nor resilient enough to provide a ball cover with normal golf ball playing characteristics. Further, Rolf makes special mention of the use of Asbestos a known toxic and carcinogenic substance. Rolf thus teaches away from the use of harmless non toxic materials that will dissolve in water in a short period of time. Further, the Rofe ball would not provide normal golf ball playing characteristics since the soft leather outer shell is subject to cutting and tearing.

U.S. Pat. Nos. 2,363,059 (C. W. Green), 2,122,279 (Crane), 2,229,170 (C. W. Green), 2,074,808 (Rickey), 1,202,490 (Davis), 785,184 (Saunders), 699,813 (Richards) and 710,750 (Cavanagh) all deal with a method of making a golf balls. However all the golf balls disclosed in the aforementioned patents deal with the method of manufacturing a long lasting golf ball from various natural and synthetic components and thus teach away from a method for the manufacture of a water soluble or disposable golf ball which will dissolve in water over a short period of time.

SUMMARY OF THE INVENTION

In summary, the present invention comprises an injection molded golf ball comprised of mixed together environmentally safe thermo setting adhesives or fillers and thermo setting adhesives which are water soluble and will dissolve in either salt or fresh water over a short period of time. Should a colored golf ball be desired a non-toxic environmentally food coloring or the like can be mixed with the thermo setting adhesives and fillers or the outside of the golf ball may be coated with the environmentally safe color. The instant invention has the physical and playing characteristics expected of conventional golf balls.

The preferred filler materials for the base slurry used to injection mold the golf ball of the instant invention is a water soluble material such as a cellulose compound, but is not limited thereto as other suitable water soluble materials that provide the required mass for proper golf ball playing characteristics and physical size may be used to practice this invention. For purposes of explanation of this invention and not by way of limitation, the water soluble filler material may also include paper pulp, sawdust, lint, straw, thread, twine, leaves, and other ecology safe materials or combinations thereof suitable for the purpose intended. Animal feremones, animal repellent, vitamins, or plant fertilizer may be added to the slurry, which upon dissolving would be beneficial to the environment and the creatures therein when the golf ball dissolves. Material to extend the time required for complete dissolution of the ball may also be added to the slurry.

The filler material is prepared by grinding to a flock like consistency. The flock like consistency filler material is then blended with a water soluble thermo setting adhesive. The viscosity of the combination allows the combined filler material and adhesive to be injection molded into a closed mold cavity under pressure in the range of 2,000 PSI to 20,000 PSI.

A water soluble adhesive for the purposes of this invention consists of, but is not limited to, the following class of materials: polymers, gelatin, glucose, fructose, animal glue, glycerine, agar (processed seaweed), guargum, non toxic white glue and the like water soluble therm setting adhesives or combinations thereof suitable for the purpose intended. The resulting heterogeneous or homogeneous mixture becomes a slurry with a proper viscosity for injection into a closed mold cavity via a sprue.

The mixture which is thermo setting due to the thermo setting characteristics of the adhesive as noted above is thoroughly blended with the filler material at a temperature between 145 to 212 degrees fahrenheit and then injected through a sprue into a closed, chilled, mold cavity and held in that cavity for sufficient time for the slurry to cure to a solid state. Mold cavity temperature and variables in the component mixture and resulting viscosity of the slurry compound will effect cure time and required slurry mixture temperature. Upon completion of this curing process a water soluble golf ball having a mass between 45 to 55 grams and a diameter not greater than 1.625 inches is produced in the mold.

The resulting golf ball comprises an exteriorly dimpled, solid, coreless, water soluble golf ball with the playing characteristics substantially equal to that of a golf ball currently used in the sport of golf.

An object of this invention is to provide a coreless solid one piece golf ball that is water soluble.

Another object of this invention is to provide a water soluble golf ball that is easily mass produced in a one step injection molding process.

Another object of this invention is to provide a water soluble golf ball that is easily mass produced in a one step injection molding process which minimizes the economic cost to manufacture.

An object of this invention is to provide a golf ball which will dissolve by fresh or salt water into the environment into which it is driven by its user.

Another object of this invention is to provide a golf ball which will dissolve by fresh or salt water into the environment into which it is driven by its user.

Another object of this invention is to provide a golf ball which will prove harmless to the animal life which occupies the environment into which the golf ball is driven.

These and other objects and advantages of the present invention will become apparent to those skilled in the art after considering the following detailed specification in which the preferred embodiment are described in conjunction with the accompanying drawing Figures.

BRIEF DESCRIPTION OF DRAWING FIGURES

FIG. 4 depicts the process steps involved in the manufacture of the invention.

DETAILED DESCRIPTION OF THE PREFERRED EMBODIMENT OF THE INVENTION

Figure 1:
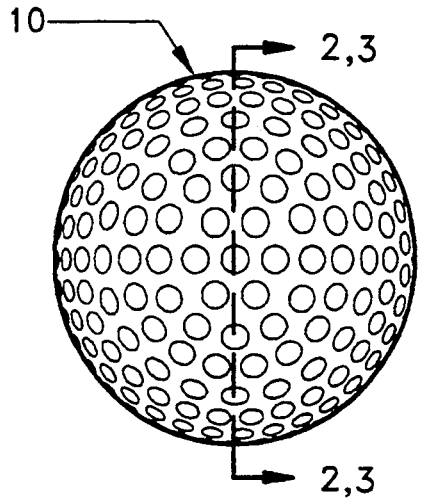
FIG. 1 depicts a side view of the water soluble golf ball invention.
Figure 2:
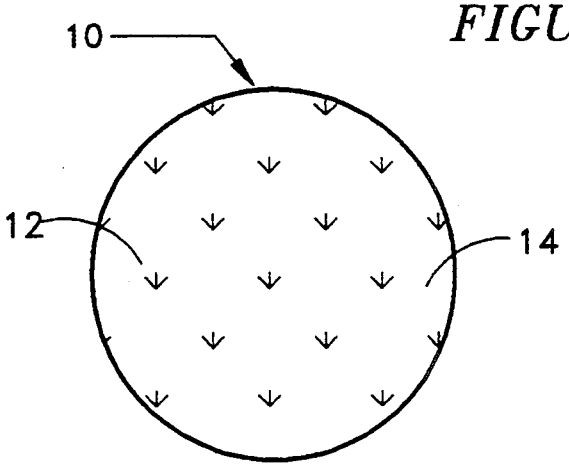
FIG. 2 is a section of the golf ball of FIG. 1 taken along line 2—2 of FIG. 1 showing a solid solution of a blend of heterogeneous material with the thermo setting adhesive.
Figure 3:
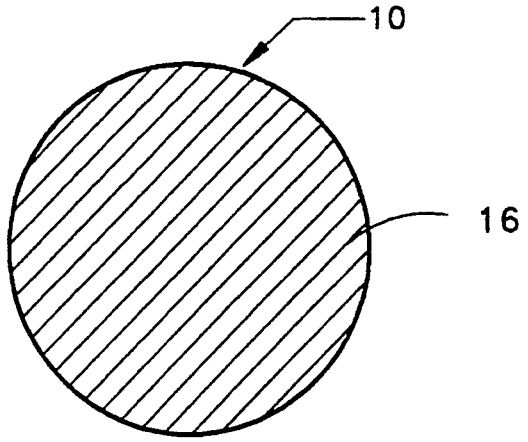
FIG. 3 is a section of the golf ball in FIG. 1 taken along line 3—3 of FIG. 1 showing a solid solution of a homogeneous blend of water soluble filler material combined with the thermo setting adhesive.

Referring now to the drawing figures. The water soluble golf ball 10 has the general appearance of a conventional dimpled golf ball as shown in FIG. 4. The water soluble golf ball 10 is formed by preferably mixing together a water soluble filler material 12 such as, for example and not by way of limitation, paper pulp, sawdust, lint, straw, thread, twine, leaves, and other ecologically safe materials or combinations thereof suitable for the purpose intended, as aforementioned, ground to a flock like consistency and a water soluble non-toxic thermo setting adhesive 14 such as, for example and not by way of limitation, polymers, gelatin, glucose, fructose, animal glue, glycerine, agar or processed seaweed, guargum, non toxic white glue and the like suitable adhesives or combination thereof for the purpose intended. The combined mixture of water soluble filler and adhesive material yields a heterogeneous or homogenous blend with the required mass or weight necessary to produce a golf ball 10 with appearance and performance characteristics expected of a conventional golf ball.

The viscosity of the slurry mixture of the combined water soluble filler material and thermo setting adhesive must have a viscosity suitable for injecting through a sprue into a mold cavity under pressure in the range between 2000 PSI to 20,000 PSI. The level of pressure will very somewhat with temperature and slurry consistency.

Food or non-toxic coloring or dyes may be added to the slurry material or the outside of the ball can be coated with the coloring material to produce a colored golf ball.

In manufacturing, the slurry temperature is elevated to a temperature between 145 and 212 degrees, injected into a chilled mold cavity under pressure and allowed to stand in the cavity until the lowering of slurry temperature over time causes the thermo setting adhesive in the slurry to harden to the degree required. After harding (curing) the water soluble golf ball is suitable for use as a golf ball.

In use, when the water soluble golf ball 10 is driven into fresh or salty water or dry areas that later become wet from the natural or artificial application of water, the ball will dissolve harmlessly over a finite period of time.

Animal feremones, animal repellent, animal vitamins, or plant fertilizer may be added to the slurry during preparation, which upon dissolving, would be beneficial to the environment and the creatures therein in which the golf ball dissolves.

Although the present invention has been shown and described with references to particular embodiments, nevertheless, various changes and modifications obvious to one skilled in the art to which the invention pertains are deemed within the purview of the invention.

What is claimed is:

1. A water soluble golf ball comprising:

a solid unitary structure having a dimpled outer surface formed from a common liquid mixture cured into a solid solution, said common liquid mixture comprising a blend of a non-toxic water soluble filler material and a non-toxic thermo setting water soluble adhesive blended together to form a slurry, said water soluble golf ball performing substantially the same as a conventional non-water soluble golf ball, said water soluble golf ball being non-toxic and soluble in water over a finite period of time.

2. The water soluble golf ball of claim 1 wherein said soluble filler material consists of a ground filler selected from one or more ingredients taken from a class of ingredients consisting of paper pulp, sawdust, lint, straw, thread, twine and leaves or combinations thereof.

3. The water soluble golf ball of claim 1 wherein said water soluble adhesive consists of an adhesive taken from a class of adhesives material consisting of polymers, gelatin, glucose, fructose, guargum, agar or processed sea weed, non-toxic white glue and animal glue or combinations thereof.

4. The water soluble golf ball of claim 1 wherein said water soluble golf ball has a mass of from 45 to 55 grams.

5. The water soluble golf ball of claim 1 wherein said water soluble golf ball has a diameter not substantially greater than 1.625 inches.

6. The water soluble golf ball of claim 1 additionally comprising the addition of animal feremones to the slurry.

7. The water soluble golf ball of claim 1 additionally comprising the addition of an animal repellent to said slurry which will repel animals therefrom.

8. The water soluble golf ball of claim 1 additionally comprising the addition of animal vitamins to said slurry.

9. The water soluble golf ball of claim 1 additionally comprising the addition of plant fertilizer to said slurry.

10. The water soluble golf ball of claim 1 additionally comprising the addition of non-toxic materials to said slurry suitable to extend the dissolving time of said golf ball.

* * * * *